US009579663B2

(12) United States Patent
McKinney

(10) Patent No.: US 9,579,663 B2
(45) Date of Patent: Feb. 28, 2017

(54) DETECTION OF ELECTROSTATIC FILTER FOR AIR FILTRATION SYSTEM

(75) Inventor: Peter Johannes McKinney, Boulder, CO (US)

(73) Assignee: CARRIER CORPORATION, Farmington, CT (US)

( * ) Notice: Subject to any disclaimer, the term of this patent is extended or adjusted under 35 U.S.C. 154(b) by 126 days.

(21) Appl. No.: 14/117,727

(22) PCT Filed: May 14, 2012

(86) PCT No.: PCT/US2012/037709

§ 371 (c)(1),
(2), (4) Date: Nov. 14, 2013

(87) PCT Pub. No.: WO2012/161995

PCT Pub. Date: Nov. 29, 2012

(65) Prior Publication Data

US 2014/0069274 A1 Mar. 13, 2014

Related U.S. Application Data

(60) Provisional application No. 61/489,559, filed on May 24, 2011.

(51) Int. Cl.
*B03C 3/68* (2006.01)
*B03C 3/66* (2006.01)
(Continued)

(52) U.S. Cl.
CPC ..... *B03C 3/68* (2013.01); *B03C 3/66* (2013.01); *B03C 3/72* (2013.01); *B03C 3/82* (2013.01); *B03C 3/86* (2013.01)

(58) Field of Classification Search
CPC combination set(s) only.
See application file for complete search history.

(56) References Cited

U.S. PATENT DOCUMENTS 4,886,526 A * 12/1989 Joannou ..... B03C 3/155 96/67
4,897,096 A 1/1990 Pischinger et al.
(Continued)

FOREIGN PATENT DOCUMENTS

DE 2447796 A1 1/1990
DE 102005033025 A1 1/2007
GB 2308320 A 6/1997

OTHER PUBLICATIONS

Notification of Transmittal of the International Preliminary Report on Patentability of the International Searching Authority, or the Declaration; PCT/US2012/037709; Nov. 26, 2013, 9 pages.
(Continued)

*Primary Examiner* — Duane Smith
*Assistant Examiner* — Sonji Turner
(74) *Attorney, Agent, or Firm* — Cantor Colburn LLP

(57) ABSTRACT

An air filtration system includes a frame directing an airflow through the air filtration system and a media filter. The media filter includes a plurality of media fibers arranged to capture particles flowing therethrough and a conductive surface located at the media filter and having a conductivity within a selected range. Two or more contact pads are located at the media filter and are alignable with an electrical circuit located at the frame to determine whether a resistance across the conductive plane is within a selected resistance range. A method of installing a media filter in an air filtration system includes inserting the media filter into a frame of the air filtration system and aligning one or more contact pads of the media filter with one or more grounding pads of the frame. A resistance across the media filter is measured.

9 Claims, 5 Drawing Sheets

(51) Int. Cl.

| | |
|---|---|
| ***B03C 3/72*** | (2006.01) |
| ***B03C 3/82*** | (2006.01) |
| ***B03C 3/86*** | (2006.01) |

(56) References Cited

U.S. PATENT DOCUMENTS 4,978,372 A * 12/1990 Pick ..... B03C 3/32 96/67
5,579,209 A * 11/1996 Manson ..... F24F 11/0009 174/50
7,261,765 B2 * 8/2007 Katayama ..... B03C 3/025 323/903
7,332,019 B2 * 2/2008 Bias ..... B03C 3/025 96/15
7,537,649 B2 * 5/2009 Pippel ..... B01D 46/0005 55/471
7,828,868 B2 * 11/2010 Evans ..... B01D 46/0005 55/471
7,833,309 B2 * 11/2010 Pippel ..... B01D 46/0005 55/471
7,837,773 B2 * 11/2010 Pippel ..... B01D 46/0005 55/357
7,914,598 B2 * 3/2011 Evans ..... B01D 46/0005 55/471
2006/0137528 A1 * 6/2006 Katayama ..... B03C 3/025 96/77
2006/0201119 A1 * 9/2006 Song ..... A61L 9/16 55/471

OTHER PUBLICATIONS

Notification of Transmittal of the International Search Report and the Written Opinion of the International Searching Authority, or the Declaration; PCT/US2012/037709; Sep. 21, 2012; 13 pages.

* cited by examiner

DETECTION OF ELECTROSTATIC FILTER FOR AIR FILTRATION SYSTEM

BACKGROUND OF THE INVENTION

The subject matter disclosed herein relates to air filtration systems. More specifically, the subject disclosure relates to filters for electrostatic air filtration systems and installation thereof.

In air filtration systems, for example, electrically enhanced air filtration systems, electrostatic filters installed in the systems collect impurities in an airflow through the system before the airflow is circulated through a space such as a home or other building. Such filters are periodically removed and replaced as their effectiveness diminishes and/or their resistance to airflow becomes impractically high due to contaminant loading in the filter. In some systems, improper filter installation, or installation of an incorrect filter as a replacement can result in reduced effectiveness of the filter and the filtration system, and in some cases safety issues.

BRIEF DESCRIPTION OF THE INVENTION

According to one aspect of the invention, an air filtration system includes a frame directing an airflow through the air filtration system and a media filter. The media filter includes a plurality of media fibers arranged to capture particles flowing therethrough and a conductive surface located at the media filter and having an electrical conductivity within a selected range. Two or more contact pads are located at the media filter and are alignable with an electrical circuit located at the frame to determine whether a resistance across the conductive surface is within a selected resistance range.

According to another aspect of the invention, a method of installing a media filter in an air filtration system includes inserting the media filter into a frame of the air filtration system and aligning one or more contact pads of the media filter with two or more grounding pads of an electrical circuit at the frame. A resistance across the media filter is measured to determine if a measured resistance is within a selected resistance range.

According to yet another aspect of the invention, a media filter for an air filtration system includes a plurality of media fibers arranged to capture particles flowing therethrough and a conductive surface located at the media filter having a conductivity within a selected range. One or more contact pads are located at the media filter, alignable with an electrical circuit disposed at the air filtration system to determine whether a resistance across the conductive surface is within a selected resistance range.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
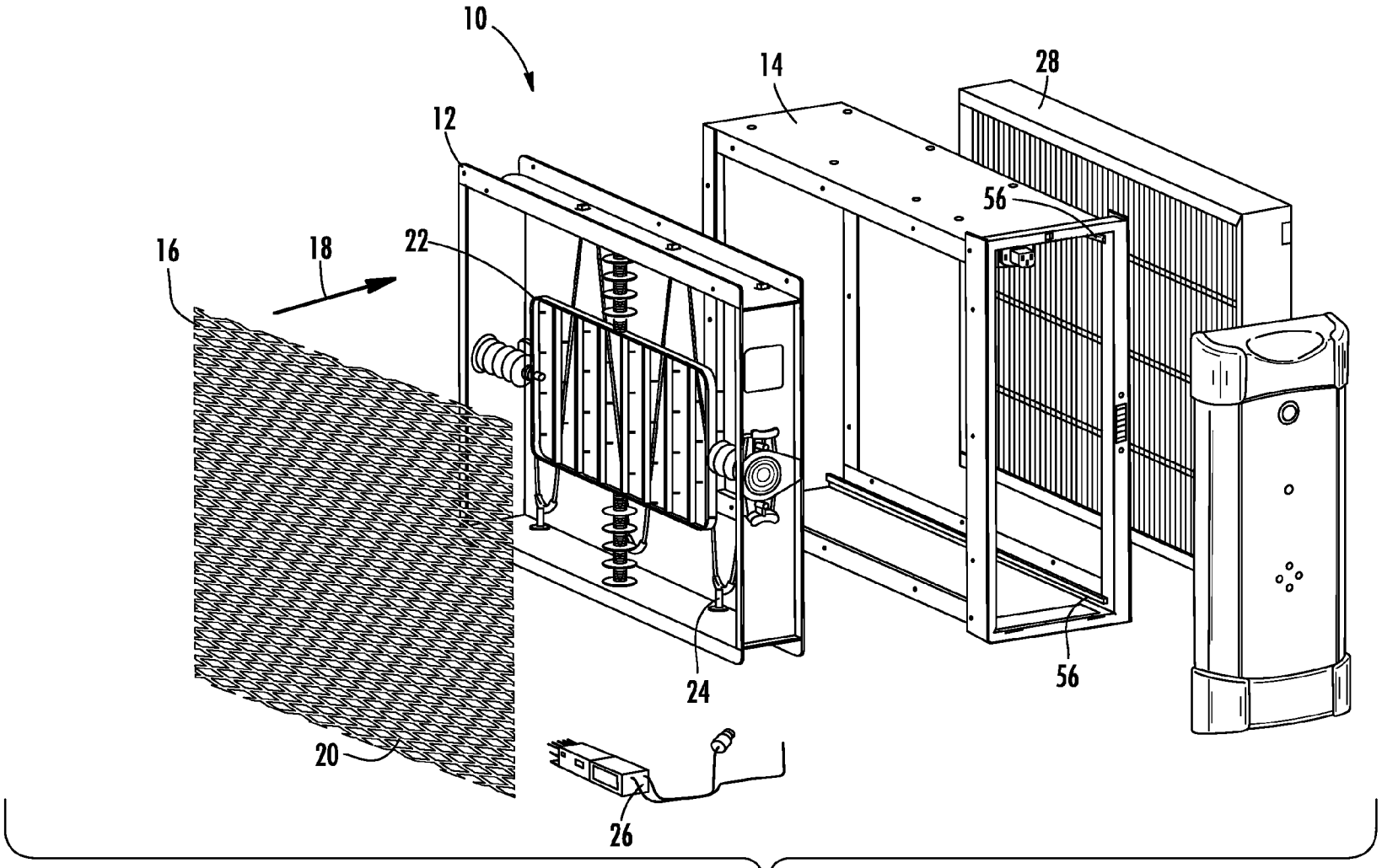
FIG. 1 schematically illustrates an embodiment of an air filtration system.

Shown in FIG. 1 is a view of an embodiment of an air filtration system 10. The air filtration system 10 of FIG. 1 is an electrically enhanced air filtration system 10, but it is to be appreciated that utilization of the present invention with other types of air filtration systems 10 having replaceable filters is contemplated within the present scope.

Figure 2:
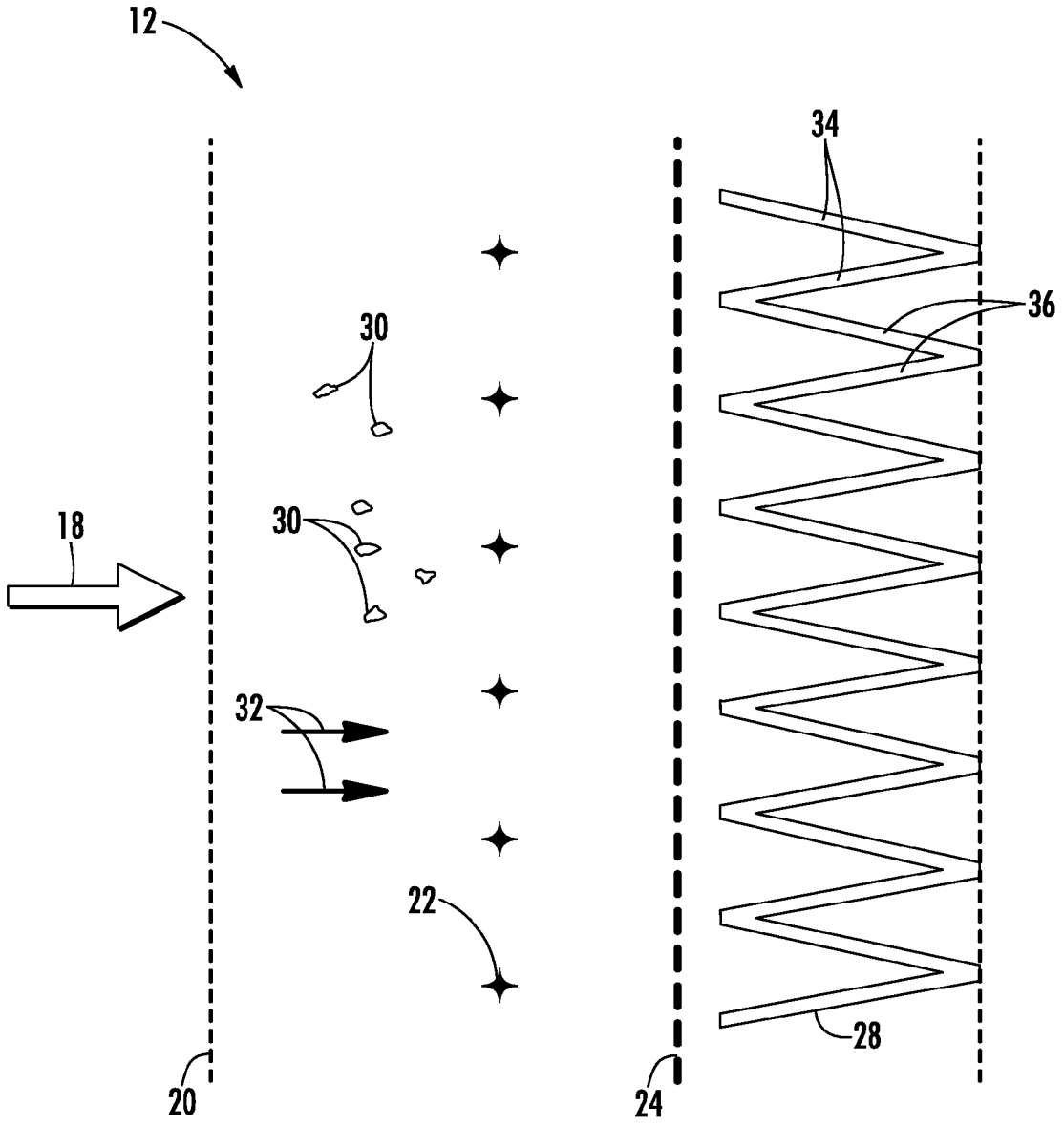
FIG. 2 is a schematic cross-sectional view of an embodiment of an air filtration system.

The air filtration system 10 includes a filter enhancement module (FEM) 12, shown in FIG. 1. At an upstream end 16 of the FEM 12, relative to an airflow direction 18 of air through the filtration system 10 is a safety screen 20 which also acts as an upstream ground for the FEM 12. Downstream of the safety screen 20 is an ionization array 22, and a field-generating array 24 located downstream of the ionization array 22. The ionization array 22 is an array of points sufficiently sharp such as to produce corona discharge when a pre-determined voltage is applied. For example, the ionization array may comprise a plurality of thin wires, barbed wires, or any structure capable of producing the corona needed to yield ions. The field-generating array 24 and the ionization array 22 are both connected to and powered by a high voltage power supply 26. The FEM 12 is located and secured in a frame 14 of the filtration system 10. A media filter 28 is disposed in the frame 14 downstream of the field-generating array 24. Referring now to FIG. 2, when the power supply 26 is activated, the ionization array 22 charges particles 30 in an airstream 32 passing through the FEM 12 by ionizing the air molecules, which then transfer their charge to the particles 30. The voltage across the field-generating array 24 polarizes a plurality of media fibers 34 of the media filter 28, which in some embodiments causes the charged particles 30 to be attracted to and captured by the media fibers 34. In other embodiments, the ionized gas (air) charges the filter media, which renders the fibers electrostatically attractive to the particles 30 whether they be charged or not.

Figure 3:
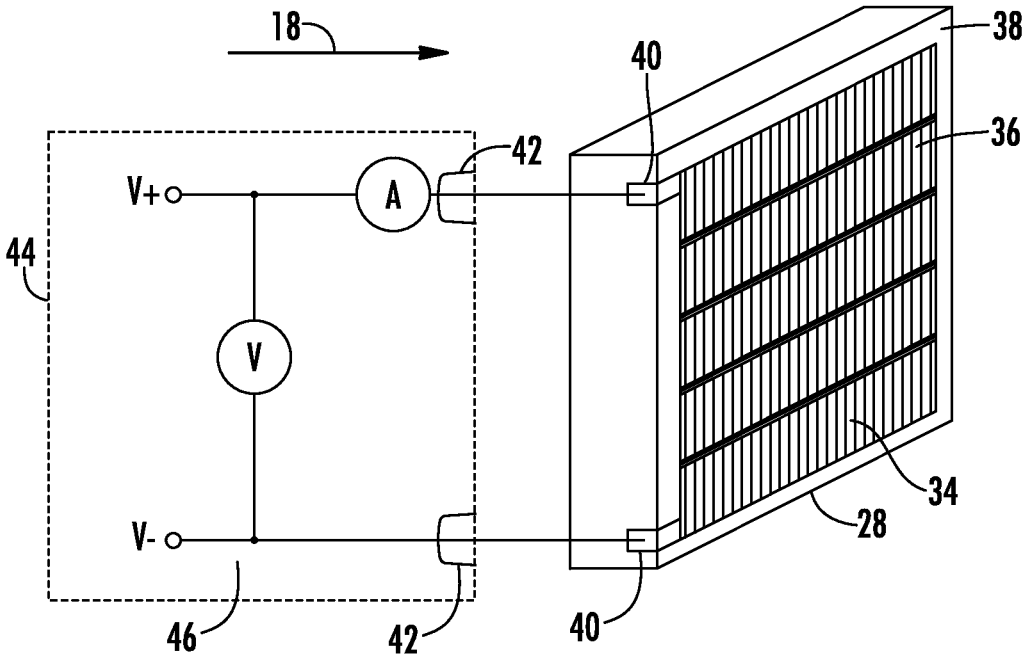
FIG. 3 is a schematic view of an embodiment of a media filter and detection circuit for an air filtration system.
Figure 4:
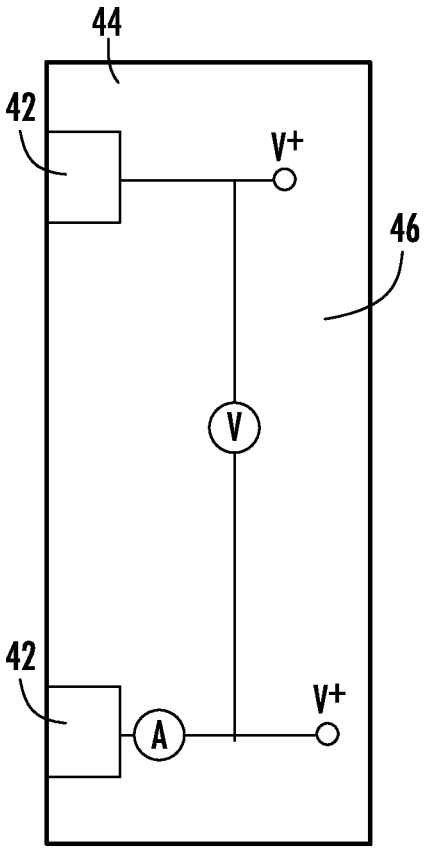
FIG. 4 illustrates an embodiment of a media filter installed in a frame.

Referring to FIGS. 3 and 4, to enhance performance of the media filter 28 and polarize the media fibers 34, the media filter 28 includes a conductive surface 36 at a downstream side 38 of the media filter 28. In order for the media filter 28 including the conductive surface 36 to function properly, the conductive surface 36 must be grounded when the media filter 28 is installed in the FEM 12 (shown in FIG. 1). The grounding is typically accomplished by aligning filter contact pads 40 on the media filter 28 connected to the conductive surface 36, with corresponding grounding contacts 42, located on a door 44 of the FEM 12. When the correct media filter 28 is installed, and installed in a correct orientation, and the door 44 is closed, the contact pads 40 align with the grounding contacts 42 to ground the conductive surface 36. While a planar media filter 28 is shown and described herein, it is to be appreciated that other filter 28 shapes are contemplated within the scope of the present invention. For example, the media filter 28 may be cylindrical or a section thereof, conical or a section thereof, spherical or a section thereof, or some other shape. Further, the conductive surface 36 may be in other locations on the media filter 28, as long as the filter contact pads 40 align with the grounding contacts 42.

To ensure that the correct media filter 28 is installed, and installed correctly, an electrical circuit 46 located in the door 44, measures a resistance across the contact pads 40 (or the location on the media filter 28 where the contact pads 40 should be). A properly installed media filter 28 will yield a resistance within a selected resistance range, depending on the conductivity, within a selected conductivity range, of the conductive plane 36. If the media filter 28 is absent, improperly installed, or is not the correct media filter for the particular FEM 12, the resistance will be "open" or above the selected resistance range. Similarly, if an incorrect media filter 28 is installed that has an electrically conductive frame or a ground surface that is more electrically conductive than desired, or an attempt is made to defeat the filter circuit by "shorting" the contacts 42 on the door 44, the resistance will be below the selected range. Additionally, if an initially properly-installed filter 28 has been in use such that it has collected an abundance of electrically conductive materials or hydroscopic materials in a moist environment that render the filter 28 more electrically conductive than optimal for effective air filtration, the resistance will be below the selected range.

Figure 5:
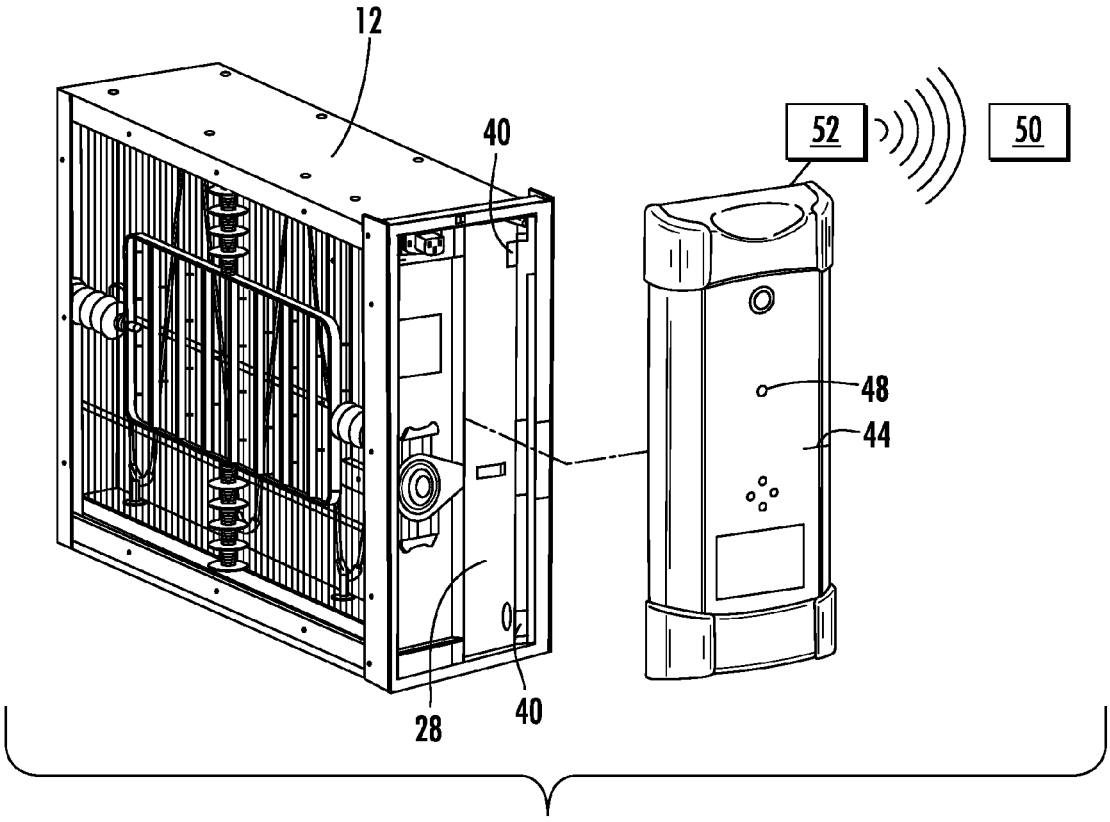
FIG. 5 is a view of an embodiment of a door for a frame.

Referring to FIG. 5, if the measured resistance is outside of the selected resistance range, an error light 48 located, for example, on the door 44, may be illuminated or flash indicating a filter installation error, or other indication of an error (for example an audible tone) may be utilized. In some embodiments, a system status based on the comparison of the measured resistance to the selected resistance range may be communicated via a communications bus 52 to a thermostat or other control or device 50, in some cases wirelessly. Further, in some embodiments, if the measured resistance is outside of the selected resistance range, the controls for FEM 12, located, for example, at the power supply 26 but possibly located elsewhere inside or outside of the system 10, may automatically stop operation to prevent a safety issue.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An air filtration system comprising:

a frame directing an airflow through the air filtration system; and a media filter including:

a plurality of media fibers arranged to capture particles flowing therethrough;

a conductive surface disposed at the media filter having a conductivity within a selected range; and two or more contact pads disposed at the media filter; and an electrical circuit disposed at the frame including ground contacts alignable with the two or more contact pads, the electrical circuit configured to measure an electrical resistance across the media filter, wherein a measured resistance within a selected resistance range is indicative of a properly installed media filter.

2. The air filtration system of claim 1, wherein the electrical circuit is disposed at a door of the frame.

3. The air filtration system of claim 2, wherein the grounding contacts are disposed at a door of the frame, and the resistance is measured via closure of the door over the media filter.

4. The air filtration system of claim 1, further comprising a light which is illuminated when the resistance is outside of the selected resistance range.

5. The air filtration system of claim 1, further comprising a communication device to communicate a system status based on the determination to a control device.

6. The air filtration system of claim 5, wherein the communication device is wirelessly connected to the control device.

7. The air filtration system of claim 5, wherein the control device is configured to stop operation of the system if a measured resistance across the conductive surface is outside of the selected resistance range.

8. The air filtration system of claim 1, wherein the electrical circuit comprises one or more grounding contacts alignable with the one or more contact pads.

9. A media filter for an air filtration system comprising:

a plurality of media fibers arranged to capture particles flowing therethrough;

a conductive surface disposed at the media filter having a conductivity within a selected range; and two or more contact pads disposed at the media filter, alignable with corresponding grounding contacts of an electrical circuit disposed at the air filtration system to determine whether a resistance across the conductive surface is within a selected resistance range, wherein a measured resistance within a selected resistance range is indicative of a properly installed media filter.

* * * * *